US005555802A

United States Patent [19]

Ohinata et al.

[11] Patent Number: 5,555,802

[45] Date of Patent: Sep. 17, 1996

[54] PRINTING DRUM OF ROTARY STENCIL PRINTER HAVING FLEXIBLE PERFORATED CYLINDER INCORPORATING ALLOWANCE FOR BULGING OUT

[75] Inventors: Yoshiharu Ohinata; Nagon Takita; Hideo Negishi, all of Tokyo, Japan

[73] Assignee: Riso Kagaku Corporation, Tokyo, Japan

[21] Appl. No.: 332,073

[22] Filed: Nov. 1, 1994

[30] Foreign Application Priority Data

Nov. 12, 1993 [JP] Japan ..... 5-306028

[51] Int. Cl.[6] ..... B41L 13/04

[52] U.S. Cl. ..... 101/116; 101/119

[58] Field of Search ..... 101/114, 115, 101/116, 117, 118, 119, 120, 127, 127.1, 128, 128.1, 129, 174, 211

[56] References Cited

U.S. PATENT DOCUMENTS

| | | | |
|---|---|---|---|
| 3,811,378 | 5/1974 | Bohm | 101/120 |
| 4,026,208 | 5/1977 | Horne, Jr. et al. | 101/116 |
| 4,911,069 | 3/1990 | Hayama et al. . | |
| 5,090,312 | 2/1992 | Ohinata | 101/120 |
| 5,255,599 | 10/1993 | Kobayashi et al. | 101/119 |

FOREIGN PATENT DOCUMENTS

| | | |
|---|---|---|
| 1204781 | 8/1989 | Japan . |
| 2225078 | 9/1990 | Japan . |

*Primary Examiner*—Edgar S. Burr
*Assistant Examiner*—Anthony H. Nguyen
*Attorney, Agent, or Firm*—Watson Cole Stevens Davis, P.L.L.C

[57] ABSTRACT

In order to make the bulging out deformation of the printing drum of a rotary stencil printer having a flexible cylindrical body by the internal press roller to be more easy and more uniform over the entire width of the printing, a flexible perforated sheet (20) forming the flexible cylindrical body of the printing drum is beforehand constructed to be a cylindrical body with its opposite annular edge portions being laid over a pair of annular portions (10*a*, 10*b*) connected with one another by a transverse bar portion (12), wherein the internal circumferential length of the cylindrical body made of the flexible perforated sheet is larger than the outer circumferential length of the annular portions by a determinate amount for allowing a part of the flexible cylindrical body to bulge radially outwardly, and the flexible cylindrical body is latched at a portion thereof laid one over the other with the transverse bar portion against relative circumferential movement while relatively movable in the radial direction within a determinate range against the transverse bar portion.

3 Claims, 2 Drawing Sheets

PRINTING DRUM OF ROTARY STENCIL PRINTER HAVING FLEXIBLE PERFORATED CYLINDER INCORPORATING ALLOWANCE FOR BULGING OUT

BACKGROUND OF THE INVENTION

1. Field of the Invention

The present invention relates to a rotary stencil printer, and more particularly to the construction of a printing drum thereof.

2. Description of the Prior Art

In order for a rotary stencil printer to quickly start up to operate normally after the start thereof such that high quality prints are available from the first or second print with almost no trial printing, and in view of the matter that, in a rotary stencil printer wherein each printing paper is pressed between a printing drum and a back press roller for each printing, while the printing drum and the back press roller must be retracted from one another at each interval between two successive supplies of printing sheets, either the printing drum or the back press roller each having a substantial mass must inevitably be frequently reciprocated, thereby substantially restricting an increase of printing speed, it has been proposed in Japanese Patent Application 63-28553 (Laid-open Publication 1-204781) by the same assignee as that of the present application to construct a rotary stencil printer such that a principal portion of the printing drum extending between opposite axial ends thereof to support a stencil sheet wrapped therearound is constructed by a flexible perforated sheet, instead of the conventional printing drum entirely made of a rigid cylindrical body, whereby a part of the cylindrical body is bulged radially outwardly by an internal press roller adapted to rotate along the inner surface of the cylindrical body, such that, according to a rotation of the printing drum in the printing operation, each portion of the flexible cylindrical body opposing the back press roller is successively bulged out by the internal press roller so as to apply a stencil printing to a printing sheet pressed between the bulged out portion of the flexible cylindrical body and the back press roller. Further, as an improvement of such a rotary stencil printer, it has also been proposed in Japanese Patent Application 1-47029 (Laid-open Publication 2-225078) by the same assignee as that of the present application to construct a printing drum such that the above-mentioned flexible cylindrical body is provided by a flexible perforated sheet having a rectangular configuration in development, said flexible perforated sheet being mounted around two annular portions forming opposite axial end portions of the printing drum with opposite side edge portions thereof being slidably seated on the outer circumferential surfaces of the two annular portions.

When the above-mentioned flexible perforated sheet is a net-like sheet made of woven or non woven or knitted fibrous materials, and when such a sheet cylindrically wound with opposite end portions thereof seated around the outer circumferential surfaces of the two annular portions is pressed radially outwardly at an axially internal portion thereof by the internal press roller, the flexible perforated sheet is bulged radially outwardly substantially uniformly over the entire axial length or width thereof contacted by the internal press roller such that a stencil print is available to have a uniform quality over the entire region of width. In this respect, when the opposite side edge portions of the flexible perforated sheet having a rectangular configuration in development are freely seated around the outer circumferential surfaces of the annular portions as arranged according to the afore-mentioned improvement, the cylindrical body shows a higher flexibility so that a higher uniformity is available in the radially outward bulging out thereof under the action of the internal press roller.

However, in order that the cylindrical body is more uniformly bulged radially outwardly by the internal press roller over the entire region of the width thereof, and in order that the printing speed is further increased, it is desired that the cylindrical body has a construction which allows for a more light and uniform bulging out thereof in response to the radially outward pressing action by the internal press roller.

SUMMARY OF THE INVENTION

In view of the above circumstances, it is an object of the present invention to provide a more improved printing drum of a rotary stencil printer which affords a lighter and more uniform bulging out in response to the radially outward pressing action by the internal press roller applied to the inside of the cylindrical body of the drum constructed by a flexible perforated sheet.

According to the present invention, the above-mentioned object is accomplished by a printing drum of a rotary type stencil printer in which said printing drum has a cylindrical body of a perforated construction adapted for carrying a perforated stencil sheet wrapped therearound, and ink supplied to the inside of said cylindrical body is supplied to said stencil sheet through perforations of said cylindrical body due to urging by an internal press roller adapted to rotate along an internal surface of said cylindrical body, wherein a part of said cylindrical body is bulged radially outwardly by said internal press roller as much as a predetermined substantial bulge out amount, while said printing drum rotates with a print sheet being pressed against said cylindrical body thereof by a back press means such that a stencil printing is applied onto the printing sheet, said printing drum having a frame body including two annular portions forming opposite end portions thereof and a transverse bar portion connecting said two annular portions with one another and equipped with a stencil sheet leading end mounting means for selectively mounting a leading end of a stencil sheet, and a flexible perforated sheet of a rectangular configuration in development with opposite side edge portions thereof being adapted to freely seat on outer circumferential surfaces of said two annular portions thus constructing said cylindrical body, characterized in that said flexible perforated sheet is constructed to be a cylindrical body having an inner circumferential length larger than the circumferential length of said outer circumferential surfaces of said annular portions as much as an amount which allows for the bulging out thereof of said predetermined amount by said internal press roller.

It is desirable that said transverse bar portion is shifted radially outwardly from a cylindrical surface enveloping the outer circumferential surfaces of said two annular portions so that said cylindrical body of the flexible perforated sheet can move radially outwardly within a determinate range at a portion thereof laid one over the other with the transverse bar portion.

The printing drum according to the present invention does not necessarily need a roller as a cooperating means for supporting the back of a printing sheet pressed against thereto, but other printing sheet back pressing means such as a plain plate, arcuate plate or the like having a highly slidable surface may be used therewith.

The flexible perforated sheet may be a sheet woven or knitted from fibers or other fibrous materials, a sheet made of non woven fiber or other fibrous materials, a plastic or metal sheet formed with a number of small openings, etc. constructed in a single layer or a composite layer, arranged to have an appropriate permeability to ink and an appropriate flexibility.

According to the above-mentioned construction wherein the cylindrical body constructed by the flexible perforated sheet has originally a diameter greater than that of the outer circumferential surfaces of said annular portions by a predetermined amount which is required for the bulging out thereof, and the cylindrical body is radially shiftable relative to said annular portions within a determinate range even at a portion thereof at which it is latched to the frame of the printing drum against a circumferential shifting relative thereto so that the cylindrical body rotates together with said annular portions in unison, the clearance due to the difference in diameter of the two mating members is in a shape of a thin arc left between the cylindrical body of the flexible perforated sheet taking a shape of real circle according to the elasticity thereof and hanging on the annular portions with the thickest portion of said thin arc positioned at the bottom of the annular portions when the bulging out is not applied to the cylindrical body, and when any portion of the cylindrical body is applied with the radially outward pressing action by the internal press roller, the clearance is swiftly concentrated to the pressed out portion so that the cylindrical body is more readily bulged radially outwardly at the pressed portion.

For example, assuming that the outer diameter of the annular portions is 150 mm and the outer diameter of the internal press roller is 50 mm, the inner diameter of the cylindrical body to be originally provided for allowing a 3 mm bulging out by the internal press roller is 150.40 mm, and therefore the clearance, when distributed over the entire circumference between the cylindrical body and the annular portions is a minute value such as 0.2 min.

Since it is at the portion laid one over the other with the transverse bar portion of the frame that the cylindrical body of the flexible perforated sheet is latched to the frame so as not to shift relative thereto in the circumferential direction thereof while being allowed to shift in the radial direction within a determinate range, the difference in diameter between the cylindrical body of the flexible perforated sheet and the cylindrical surface enveloping the outer circumferential surfaces of the two annular portions is compensated for at a phase of each printing rotation of the printing drum occupying a period extending between the end of printing of a print sheet and the beginning of printing of a next print sheet, so that there occurs no such problem that a scar is caused in the printing image due to the difference in diameter between the two mating members.

Further, when the transverse bar portion is shifted radially outwardly from the cylindrical surface enveloping the outer circumferential surfaces of the two annular portions, the latching means for restricting the circumferential shifting of the cylindrical body of the flexible perforated sheet relative to the annular portions may be provided at the transverse bar portion such that the transverse bar portion also serves as a means for holding the cylindrical body from the radially outside thereof against disassembling of the cylindrical body from the frame of the printing drum. In such a construction, if the amount of the radially outward shifting of the transverse bar portion from the outer circumferential surfaces of the annular portions is equal to or greater than the amount of the bulging out of the cylindrical body of the flexible perforated sheet by the internal press roller, it is allowed that the printing drum is rotated with the internal press roller being kept at the bulging out position even when the transverse bar portion traverses the acting position of the inner press roller.

According to the above-mentioned construction of the present invention the uniformity of printing is more improved along the length as well as the width of the prints, and further the printing speed of the printer can be further increased by being supported by the easier deformation of the cylindrical body.

BRIEF DESCRIPTION OF THE DRAWING

In the accompanying drawing.

DESCRIPTION OF THE PREFERRED EMBODIMENT

In the following the present invention will be described in more detail with respect to an embodiment in reference to the accompanying drawing.

Figure 1A:
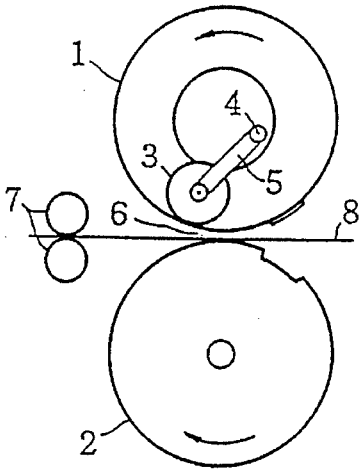
FIGS. 1*a* and 1*b* are diagrammatical views showing the basic construction of the rotary stencil printer employing a printing drum formed of a flexible cylindrical body in two different operating conditions.
Figure 1B:
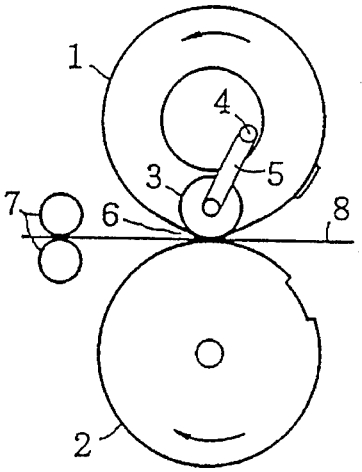

FIGS. 1*a* and 1*b* attached hereto show diagrammatically the basic construction of a rotary stencil printer concerned with the present invention in which the cylindrical body of the printing drum is essentially constructed by a flexible perforated sheet. The basic construction of the rotary stencil printer shown in these figures is the same as those shown in the afore-mentioned Japanese Patent Applications 63-28553 and 1-47029. In FIGS. 1*a* and 1*b*, a portion designated by reference numeral 1 is a printing drum, a portion designated by reference numeral 2 is a back press roller, and a portion designated by reference numeral 3 is an internal press roller. The cylindrical portion of the printing drum 1, except opposite end portions thereof, is constructed by a flexible perforated sheet, and when the internal press roller 3 rotatably supported by arm members 5 adapted to pivot about a pivot axis 4 is retreated inwardly of the natural cylindrical shape of the printing drum 1 as shown in FIG. 1*a*, the outer circumferential surface of the printing drum 1 is distant from the back press roller 2 so as to leave a clearance 6 therebetween, whereas when the arm members 5 are turned in the anti-clockwise direction as viewed in the figure about the pivot axis 4 as shown in FIG. 1*b*, the internal press roller 3 pushes a corresponding portion of the cylindrical body of the printing drum constructed by the flexible perforated sheet radially outwardly so as to press a printing sheet 8 between the bulged out portion and the back press roller 2, said printing sheet being fed into the clearance 6 by a pair of feed rollers 7, whereby the printing sheet 8 is provided with a stencil printing according to a stencil image of a perforated stencil sheet wrapped around the printing drum 1.

Figure 2:
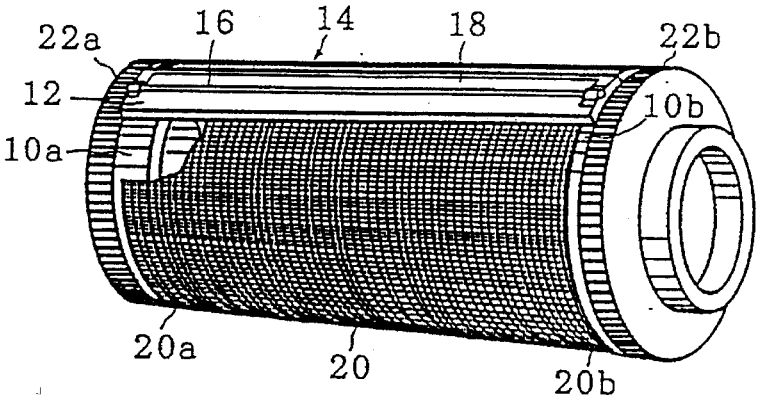
FIG. 2 is a perspective view showing an example of a printing drum in which the flexible perforated sheet constructing the flexible cylindrical body is made of a net woven from a wire material.

FIG. 2 is a perspective view showing the printing drum 1 in an isolated condition. The construction of the printing drum shown in FIG. 2 is the same as the basic construction proposed by the aforementioned Japanese Patent Application 1-47029, and comprises a frame including two annular portions 10*a* and 10*b* constructing opposite axial end portions of the printing drum and a transverse bar portion 12 connecting these two annular portions with one another. The transverse bar portion 12 is equipped with a stencil sheet leading end mounting means 14 for selectively mounting a leading end of a stencil sheet thereto. In the shown embodiment, the stencil sheet leading end mounting means 14 comprises a flap 18 adapted to pivot by means of a shaft 16 for about 180° around the axis of the pivot shaft and adapted to selectively clamp a leading end of a stencil sheet between itself and the transverse bar portion 12 for a selective mounting of the leading end of the stencil sheet to the transverse bar portion 12.

A flexible perforated sheet 20 having a rectangular configuration in development is rounded into a cylindrical configuration with opposite side edge portions 20*a* and 20*b* freely seated around the outer circumferential surfaces of the annular portions 10*a* and 10*b* so as thereby to construct a cylindrical body of a printing drum. Although not shown in detail in FIG. 2, if described by the same reference numerals as in FIG. 2 in the printing drum proposed by the aforementioned Japanese Patent Application 1-47029, the leading end portion of the flexible perforated sheet 20 as viewed in the direction of rotation of the printing drum is fastened to the transverse bar portion 12, while a trailing end portion thereof is mounted such that it is applied with a tension load by spring means. In the printing drum construction shown in FIG. 2, the flexible perforated sheet 20 is a net material woven from a wire material.

The annular portions 10*a* and 10*b* are integrally formed with gear wheels 22*a* and 22*b*, respectively. These gear wheels are meshed with corresponding gear wheels provided at opposite axial end portions of the back press roller 2 or pinions installed in the printer but not shown in the figure, serving to rotationally drive the printing drum.

Figure 3:
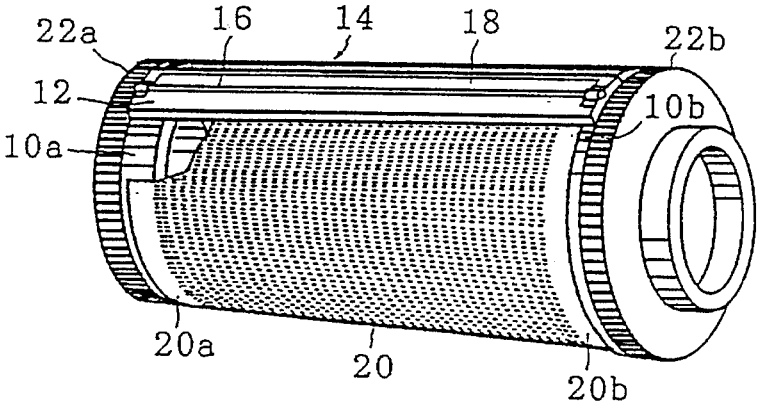
FIG. 3 is a perspective view showing an example of a printing drum in which the flexible perforated sheet constructing the flexible cylindrical body is a sheet material made of a metal plate formed with small holes.

FIG. 3 is a perspective view similar to FIG. 2, showing a printing drum having substantially the same construction as the printing drum shown in FIG. 2. However, in the printing drum shown in FIG. 3 the flexible perforated sheet 20 is made of an elastic thin metal plate formed to have a perforated construction by a number of small openings formed at a middle portion excluding opposite side edge portions thereof. In FIG. 3 the portions corresponding to those shown in FIG. 2 are designated by the same reference numerals.

Figure 4A:
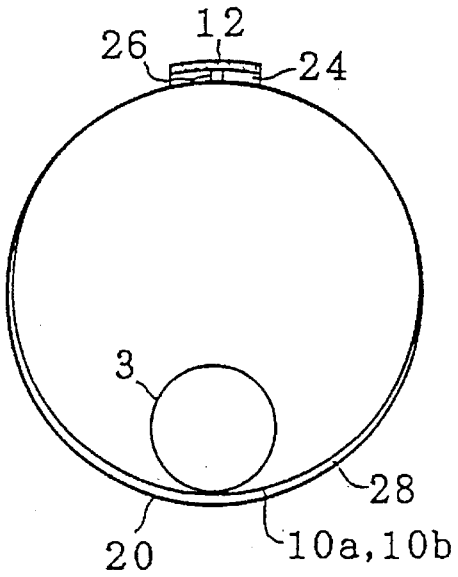
FIGS. 4*a*, 4*b* and 4*c* are diagrammatical views showing an embodiment of the printing drum according to the present invention in three different operating conditions related to the internal press roller.
Figure 4B:
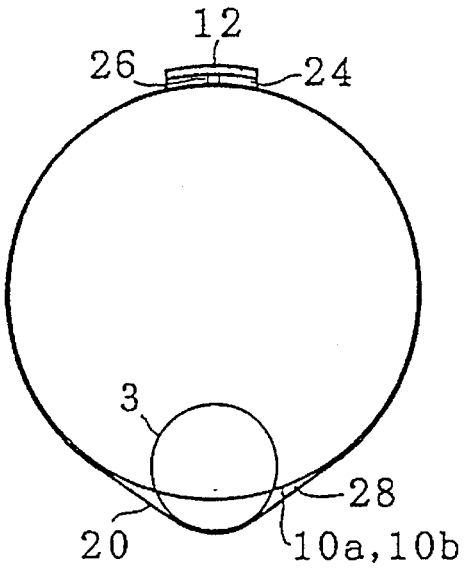
Figure 4C:
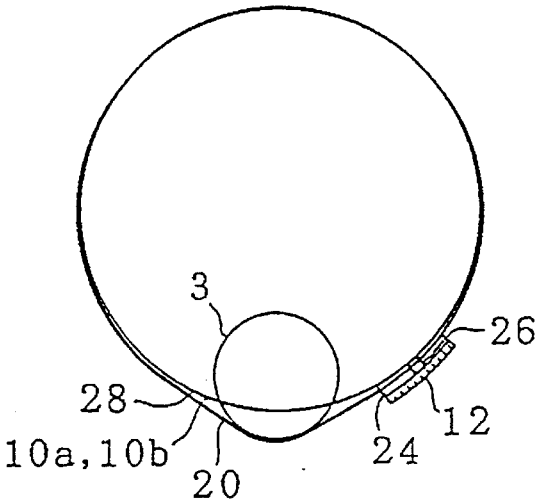

An embodiment of incorporation of the present invention into the printing drum having the above-mentioned basic construction is shown in FIGS. 4*a*, 4*b* and 4*c* in a diagrammatical illustration of an essential portion thereof for the clarity of illustration.

According to the present invention, the flexible perforated sheet 20 is beforehand (or originally) constructed to be a cylindrical body having an inner circumferential length larger than the outer circumferential length of the annular portions 10*a* and 10*b* by a predetermined amount which is required for the bulging out thereof. On the other hand, the transverse bar portion 12 is provided such that the intermediate portion thereof extending between opposite end portions thereof adapted to be laid one over the other with the cylindrical body of the flexible perforated sheet 20 is shifted radially outwardly from the outer circumferential surface of the annular portions 10*a* and 10*b* by an amount so as much as to leave a space 24 for allowing the cylindrical body to bulge out at the overlapping portion. The cylindrical body of the flexible perforated sheet 20 is arranged to pass through the space 24 at a, portion thereof laid one over the other with the transverse bar portion 12. Pins 26 are each provided to radially traverse the space between the opposite end portions of the transverse bar portion 12 and the corresponding annular portions 10*a* and 10*b* through corresponding holes formed at side edge portions of the flexible perforated sheet 20 in the form of the cylindrical body passing through the space. It will be noted that, although a clearance 28 between the cylindrical body 20 and the annular portions 10*a* and 10*b* is shown with exaggeration in the figure for the purpose of clarity of illustration, when the outer diameter of the annular portions 10*a* and 10*b* is 150 mm, while the outer diameter of the internal press roller 3 is 50 mm as in the aforementioned example, the maximum clearance at the bottom of the arc shaped clearance required for providing the bulging out of 3 mm is of a minute amount of the order of 0.4 mm.

When the inner press roller 3 is in a retreated position as shown in FIG. 4*a*, the cylindrical body of the flexible perforated sheet 20 is in a condition seated on top portions of the outer circumferential surfaces of the annular portions 10*a* and 10*b* at opposite side edge portions thereof under the action of the gravity, while the cylindrical body of the flexible perforated sheet 20 is taking a shape of a substantially true circle due to the elasticity of the flexible perforated sheet, so that the clearance 28 between the inner circumferential surface of the cylindrical body and the outer circumferential surfaces of the annular portions 10*a* and 10*b* due to the difference in diameter therebetween takes the shape of a thin arc thickest at the lowermost portion thereof.

FIG. 4*b* shows a condition that the cylindrical body of the flexible perforated sheet 20 is bulged radially outwardly at a portion thereof by a radially outward shifting of the inner press roller 3. As will be appreciated, the margin for the bulging out of the flexible perforated sheet 20 at the portion pushed by the internal press roller 3 is readily available by the clearance 28 being cancelled therearound. Since the opposite side edge portions of the flexible perforated sheet 20 are freely seated on the outer circumferential surfaces of the annular portions 10*a* and 10*b* when the flexible annular sheet 20 is formed into the cylindrical body, the deformation of the flexible perforated sheet from the condition shown in FIG. 4*a* to that shown in FIG. 4*b* occurs lightly and quickly, so that the bulging out deformation of the flexible perforated sheet can lightly and quickly follow the relative shifting of the internal press roller against the flexible perforated sheet due to a rotation of the printing drum.

It is to be noted, however, that it is only during a stationary condition of the printing drum that the cylindrical body of the flexible perforated sheet 20 is diametrically shifted downward relative to the annular portions 10*a* and 10*b* under the action of the gravity such that the clearance 28 due to the difference in diameter of the two mating members becomes the greatest at the lowermost portion thereof so as thereby to generate such-an arc clearance as shown in FIG. 4*a*, and that the largest amount of the clearance at the lowermost portion is of the order of 0.4 mm as in the afore-mentioned example. Therefore, even if the ink contained in the printing drum would flow into such a clearance, since the ink in the printing drum is applied with no pressing action by the internal press roller or centrifugal force during the stationary condition of the printing drum, the ink is held from deeply flowing into the clearance by the viscosity thereof such that there would occur no leakage of ink through the clearance during the stoppage of the printing drum. During the rotation of the printing drum, the cylindrical body of the flexible perforated sheet 20 is in a condition generally coaxial with the annular portions 10*a* and 10*b* so that the clearance between the mating members is reduced to an amount such as 0.2 mm which would not allow any substantial ink to leak therethrough.

Thus, according to the present invention, during the operation of the printing drum the cylindrical body of the flexible perforated sheet 20 is in a condition substantially closely adhered around the annular portions 10*a* and 10*b* with a minute clearance such as 0.2 mm when no portion thereof is bulged out by the internal press roller, so that there occurs no leakage of ink through the clearance between the flexible perforated sheet and the annular portions, while, nevertheless, when the bulging out action is applied by the internal press roller, a local bulging out of the order of 3 mm is easily and quickly generated. When the flexible perforated sheet is stationarily held at the portion traversing the transverse bar portion, it is avoided that a part of the flexible perforated sheet is lifted up according to the traction applied thereto by a stencil sheet being peeled off therefrom during the process of discharging the stencil sheet due to the viscosity of ink as would occur in the printing drum proposed by the afore-mentioned Japanese Patent Application 1-47029 in which the trailing end portion of the flexible perforated sheet is expanded toward the transverse bar portion by spring means, thus also ensuring a stable operation of the stencil printer during the stencil discharging process.

Further, since the flexible perforated sheet 20 formed into a cylindrical body is shiftable radially outwardly from the outer circumferential surfaces of the annular portions 10*a* and 10*b* within a determinate range at the portion traversing the transverse bar portion 12, when a portion of the flexible perforated sheet relatively close to the portion traversing the transverse bar portion is bulged out by the internal press roller as shown in FIG. 4*c*, the bulging out performance of the flexible perforated sheet is not affected by the transverse bar portion.

Although the present invention has been described above in detail with respect to a preferred embodiment thereof, it will be apparent for those skilled in the art that the present invention is not limited to these embodiments and various other embodiments are possible within the scope of the present invention.

We claim:

1. In a rotary type stencil printer including a printing drum having a generally cylindrical configuration with opposite ends and perforated at a central circumferential area thereof, an internal press roller disposed in said printing drum, means for mounting said internal press roller to be selectively pressed against said printing drum from the inside thereof radially outwardly, and a back press means opposing said printing drum from the outside thereof along a generatrix thereof with a clearance left therebetween, said stencil printer carrying out a stencil printing to apply a stencil print on a print sheet supplied between said printing drum and said back press means with a perforated stencil sheet mounted around said printing drum and an ink supplied to the inside of said printing drum and squeezed by said internal press roller into the perforations of said printing drum with a simultaneous bulging out of a portion of said printing drum opposing said back press means so as thereby to cancel said clearance, said printing drum comprising a frame body including two annular portions each having an outer circumference of a predetermined first circumferential length and providing said opposite ends of said printing drum and a transverse bar portion connecting said two annular portions with one another and equipped with a stencil sheet leading end mounting means for holding a leading end of a stencil sheet mounted around said printing drum, and a cylindrical body of a flexible perforated sheet having an inside circumference of a predetermined second circumferential length and disposed around said annular portions of said frame body such that axially opposite end portions of said cylindrical body are freely seated on outer circumferential surfaces of said two annular portions of said frame body and said cylindrical body defines said cylindrical configuration of said printing drum, wherein said second circumferential length of the inside circumference of said cylindrical body is greater than said first circumferential length of the outer circumferential surfaces of said annular portions of said frame body by as much as a predetermined amount which accommodates said bulge out of the portion of said printing drum opposing said back press means to cancel said clearance during the printing operation of the stencil printer.

2. A printing drum according to claim 1, wherein said transverse bar portion of said frame body is shifted radially outwardly from a cylindrical configuration enveloping the outer circumferential surfaces of said two annular portions of said frame body so as not to radially interfere with said cylindrical body of the flexible perforated sheet when said cylindrical body is bulged out by said internal press roller at portion thereof opposing said transverse bar portion.

3. A printing drum according to claim 1, wherein said cylindrical body of the flexible perforate sheet is engaged with said frame body at a circumferential position thereof opposing said transverse bar member against a relative rotation therebetween.

* * * * *